US010049613B2

(12) United States Patent
Kimura et al.

(10) Patent No.: US 10,049,613 B2
(45) Date of Patent: Aug. 14, 2018

(54) IMAGE PROCESSING APPARATUS AND IMAGE PROCESSING METHOD

(71) Applicant: CANON KABUSHIKI KAISHA, Tokyo (JP)

(72) Inventors: Takushi Kimura, Kawasaki-shi (JP); Masahiro Kamiyoshihara, Kamakura (JP); Shigeki Kondo, Hiratsuka (JP); Tatsuro Yamazaki, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 14/687,779

(22) Filed: Apr. 15, 2015

(65) Prior Publication Data

US 2015/0302794 A1 Oct. 22, 2015

(30) Foreign Application Priority Data

Apr. 17, 2014 (JP) ..... 2014-085605
Feb. 13, 2015 (JP) ..... 2015-026682

(51) Int. Cl.
*G09G 3/3225* (2016.01)

(52) U.S. Cl.
CPC ... *G09G 3/3225* (2013.01); *G09G 2320/0233* (2013.01); *G09G 2320/0271* (2013.01); *G09G 2320/045* (2013.01)

(58) Field of Classification Search
None
See application file for complete search history.

(56) References Cited

U.S. PATENT DOCUMENTS

2007/0080905 A1* 4/2007 Takahara ..... G09G 3/3233 345/76
2009/0052774 A1* 2/2009 Yoshii ..... G06T 5/009 382/167
2013/0010016 A1* 1/2013 Sasaki ..... G09G 3/20 345/690

FOREIGN PATENT DOCUMENTS

JP 2001-222257 A 8/2001
JP 2005-284172 A 10/2005
JP 2005-345722 A 12/2005

* cited by examiner

*Primary Examiner* — Amr Awad
*Assistant Examiner* — Andre Matthews
(74) *Attorney, Agent, or Firm* — Cowan, Liebowitz & Latman, P.C.

(57) ABSTRACT

An image processing apparatus, includes: a first storage unit configured to store first correction data reducing brightness unevenness corresponding to a first gradation value; a second storage unit configured to store second correction data reducing brightness unevenness corresponding to a second gradation value which is lower than the first gradation value; and a correction unit configured to correct gradation values, which are not less than the first gradation value, of the input image data, in use of at least the first correction data, and corrects gradation values, which are less than the first gradation value, of the input image data, in use of at least the second correction data.

17 Claims, 10 Drawing Sheets

FIG. 4

| GRADATION RANGE | INTERNAL DIVISION RATIO | CORRECTION VALUE A | CORRECTION VALUE B |
|---|---|---|---|
| $d \geqq th$ | 1 | CORRECTION VALUE OF FIRST CORRECTION DATA | CORRECTION VALUE OF FIRST CORRECTION DATA |
| $th > d > bl$ | $\frac{d-bl}{th-bl}$ | CORRECTION VALUE OF FIRST CORRECTION DATA | CORRECTION VALUE OF SECOND CORRECTION DATA |
| $d \leqq bl$ | $\frac{d}{bl}$ | CORRECTION VALUE OF SECOND CORRECTION DATA | 0 |

LESS THAN FIRST GRADATION VALUE

NOT LESS THAN FIRST GRADATION VALUE

FIG. 10

| GRADATION RANGE | INTERNAL DIVISION RATIO | CORRECTION VALUE A | CORRECTION VALUE B |
|---|---|---|---|
| $d \geqq p3$ | 1 | 0 | 0 |
| $p3 > d \geqq th$ | $\frac{d-th}{p3-th}$ | 0 | CORRECTION VALUE OF FIRST CORRECTION DATA |
| $th > d > bl$ | $\frac{d-bl}{th-bl}$ | CORRECTION VALUE OF FIRST CORRECTION DATA | CORRECTION VALUE OF SECOND CORRECTION DATA |
| $d \leqq bl$ | $\frac{d}{bl}$ | CORRECTION VALUE OF SECOND CORRECTION DATA | 0 |

IMAGE PROCESSING APPARATUS AND IMAGE PROCESSING METHOD

BACKGROUND OF THE INVENTION

Field of the Invention

The present invention relates to an image processing apparatus and an image processing method.

Description of the Related Art

Display elements (pixel circuit) of an active matrix type organic EL display apparatus include organic EL elements and thin-film transistors (TFT). The current flowing through an organic El element is controlled by controlling the voltage to be applied to the display element, whereby emission brightness of the organic EL element is controlled. FIG. 9 shows a diagram depicting an example of the relationship between the voltage to be inputted to a display element (input voltage) and a emission brightness of the display element. FIG. 9 also shows a circuit diagram of the display element. The emission amount of the organic El element is approximately in proportion to the current flowing through the organic EL element. Therefore the relationship between the input voltage of the display element and the emission brightness is similar to the V-I characteristic of the TFT. In concrete terms, as shown in FIG. 9, the emission brightness of the display element rises from the vicinity of the threshold voltage Vth of TFT. Hence, if the electric characteristics (e.g. threshold voltage Vth) of the TFT disperse among the display elements, the relationship between the input voltage and the emission brightness disperses among the display elements, and brightness unevenness is generated in the display image (image displayed on the screen). Dispersion of characteristics of the display elements, such as the electric characteristics of TFT, is generated, for example, due to manufacturing problems of the display elements. The characteristics of the display elements also change by a change in ambient temperature of the display elements and deterioration due to aging of the display elements. Therefore dispersion of characteristics of the display elements is also generated by a change in ambient temperature of the display elements and deterioration due to aging of the display elements.

Prior arts to solve these problems are disclosed, for example, in Japanese Patent Application Laid-open No. 2005-345722, Japanese Patent Application Laid-open No. 2005-284172, and Japanese Patent Application Laid-open No. 2001-222257.

Japanese Patent Application Laid-open No. 2005-345722 discloses a technique of disposing a boot strap function and a Vth cancellation function in a display element (pixel circuit) to correct the V-I characteristics of the TFT in the circuit before the light emitting period of the display element.

Japanese Patent Application Laid-open No. 2005-284172 discloses a technique of preparing a gain correction value and an offset correction value to correct the dispersion of the threshold voltage Vth of the TFT and dispersion of the inclination of the V-I characteristics of the TFT in advance, and correcting the brightness of the image data using these correction values.

Japanese Patent Application Laid-open No. 2001-222257 discloses a technique of controlling the emission brightness without using a sub-threshold region where the dispersion of the V-I characteristics of the TFT is large. In concrete terms, a technique of controlling the emission amount of an organic El element by time-division is disclosed.

As shown in FIG. 9, the V-I characteristics of the TFT that supplies current to the organic EL element change at threshold voltage Vth as a turning point. In the V-I characteristics in a range of the input voltage which is less than the threshold voltage Vth (sub-threshold region), the current exponentially changes with respect to the input voltage. Therefore in the range of the input voltage which is less than the threshold voltage Vth, it is difficult to accurately control the current, and the brightness unevenness may be generated when images are displayed at a very low brightness when the input voltage is less than the threshold voltage Vth.

However, in the technique disclosed in Japanese Patent Application Laid-open No. 2005-345722 and Japanese Patent Application Laid-open No. 2005-284172, the V-I characteristics in the range of the input voltage which is not less than the threshold voltage Vth can be corrected, but the V-I characteristics in the range of the input voltage which is less than the threshold voltage cannot be corrected. In other words, in the case of the techniques disclosed in Japanese Patent Application Laid-open No. 2005-345722 and Japanese Patent Application Laid-open No. 2005-284172, brightness unevenness generated when display brightness is very low cannot be corrected.

Further, In the case of the technique disclosed in Japanese Patent Application Laid-open No. 2001-222257, the emission amount is controlled by time-division, hence the image quality of the display image deteriorates when a moving image is displayed. For example, when a moving image is displayed, such a problem as false contour (pseudo-contour) is generated in the displayed image.

SUMMARY OF THE INVENTION

The present invention provides a technique to reduce brightness unevenness of a self-emitting display apparatus, such as an organic EL display apparatus, at high accuracy without causing deterioration of the image quality of the displayed image.

The present invention in its first aspect provides an image processing apparatus, comprising:

a first storage unit configured to store first correction data reducing brightness unevenness generated on a screen of a self-emitting display apparatus when an image based on image data of a first gradation value is displayed on the screen;

a second storage unit configured to store second correction data reducing brightness unevenness generated on the screen when an image based on an image data of a second gradation value, which is lower than the first gradation value, is displayed on the screen; and a correction unit configured to correct gradation values, which are not less than the first gradation value, of the input image data, in use of at least the first correction data, and corrects gradation values, which are less than the first gradation value, of the input image data, in use of at least the second correction data.

The present invention in its second aspect provides an image processing method, comprising:

a first reading step of reading first correction data reducing brightness unevenness generated on a screen of a self-emitting display apparatus from a first storage unit configured to store the first correction data when an image based on image data of a first gradation value is displayed on the screen;

a second reading step of reading second correction data reducing brightness unevenness generated on the screen from a second storage unit configured to store the second correction data when an image based on image data of a second gradation value, which is lower than the first gradation value, is displayed on the screen; and a correction step of correcting gradation values, which are not less than the first gradation value, of input image data, in use of at least the first correction data, and correcting gradation values, which are less than the first gradation value, of the input image data, in use of at least the second correction data.

The present invention in its third aspect provides a non-transitory computer readable medium that stores a program, wherein the program causes a computer to execute the method.

According to the present invention, brightness unevenness of a self-emitting display apparatus, such as an organic EL display apparatus, can be reduced at high accuracy without causing deterioration of the image quality of the displayed image.

Further features of the present invention will become apparent from the following description of exemplary embodiments with reference to the attached drawings.

BRIEF DESCRIPTION OF THE DRAWINGS

FIG. 4 is a table showing an example of operation of a correction value determination unit according to Example 1;

FIG. 10 is a table showing an example of operation of a correction value determination unit according to Example 4.

DESCRIPTION OF THE EMBODIMENTS

Example 1

An image processing apparatus and an image processing method according to Example 1 of the present invention will now be described with reference to the drawings.

A case of the image processing apparatus disposed in an image display apparatus will be described in this example, but the image processing apparatus according to Example 1 may be a separate apparatus from the image display apparatus.

A case when the image display apparatus is an organic EL display apparatus will be described in this example, but the image display apparatus is not limited to the organic EL display apparatus. The image display apparatus can be any self-emitting display apparatus, and may be a plasma display apparatus, for example.

Figure 1:
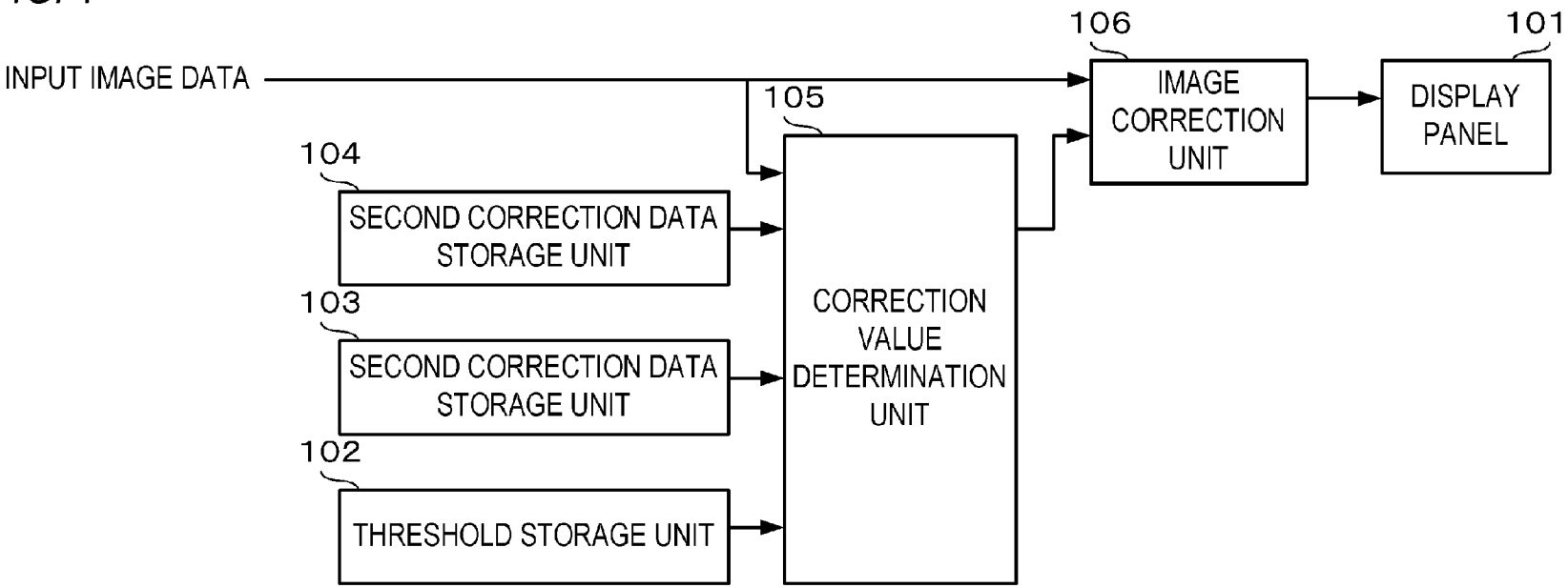
FIG. 1 is a diagram depicting an example of a functional configuration of an image display apparatus according to Example 1.

FIG. 1 is a diagram depicting an example of a functional configuration of the image display apparatus according to Example 1.

As shown in FIG. 1, the image display apparatus includes a display panel 101, a threshold storage unit 102, a first correction data storage unit 103, a second correction data storage unit 104, a correction value determination unit 105 and an image correction unit 106.

The display panel 101 is a self-emitting display panel. The display panel 101 has three types of display elements, for example: R display elements that emit red light, G display elements that emit green light, and B display elements that emit blue light. In this example, the display panel 101 is an active matrix type organic EL panel, and the display elements include organic EL elements and thin-film transistors (TET).

In this example, a case when the pixel values of the image data are RGB values having R gradation values corresponding to red, G gradation values corresponding to green and B gradation values corresponding to blue will be described. The R display elements emit light at a emission brightness corresponding to the R gradation value, the G display elements emit light at a emission brightness corresponding to the G gradation value, and the B display elements emit light at a emission brightness corresponding to the B gradation value. The display elements emit light at a higher emission brightness as the gradation value is higher.

In this example, the R gradation values, G gradation values and B gradation values of the input image data are individually corrected.

The pixel values of the image data are not limited to RGB values. For example, the pixel values may be YCbCr values that include Y gradation values to indicate the brightness, and Cb gradation values and Cr values to indicate the color difference. In this case, the Y gradation values, Cb gradation values and Cr gradation values of the input image data are individually corrected, the corrected pixel values (YCbCr values) are converted into RGB values, and the converted pixel values (RGB values) are inputted to the display panel 101. It is also acceptable that the pixel values (YCbCr values) of the input image data are converted into RGB values, the converted pixel values (RGB values) are corrected, and the corrected pixel values (RGB values) are inputted to the display panel 101.

The display elements are not limited to the R display elements, the G display elements and the B display elements. For example, Ye display elements that emit yellow may be used. In this case, pixel values having gradation values for driving the Ye display elements (Ye gradation values corresponding to yellow) can be used.

The threshold storage unit 102 stores a threshold of gradation values of the input image data. In this example, two thresholds, a first gradation value and a second gradation values, are recorded in the threshold storage unit 102.

For the threshold storage unit 102, a semiconductor memory, a magnetic disk, an optical disk or the like can be used.

The first gradation value is a gradation value of a portion where the correspondence of the voltage to be inputted to a display element (input voltage) and the emission brightness of the display element changes, within the range of the possible gradation values of the image data. In concrete terms, the first gradation value is a gradation value corresponding to the input voltage near the threshold voltage Vth of the TFT. The first gradation value can be determined based on the emission characteristic of the display panel 101.

In a range of very low gradation values where the input voltage to the display element is not greater than the threshold voltage Vth of the TFT, the emission brightness exponentially changes with respect to the input voltage, hence the dispersion of emission brightness among the display elements increases. Therefore if the emission brightness of the display element is measured for each of the possible gradation values of the display target image data, dispersion of the emission brightness among the display elements increases in a range of very low gradation values, where the input voltage corresponding to the gradation values is not greater than the threshold voltage Vth of the TFT.

Figure 2:
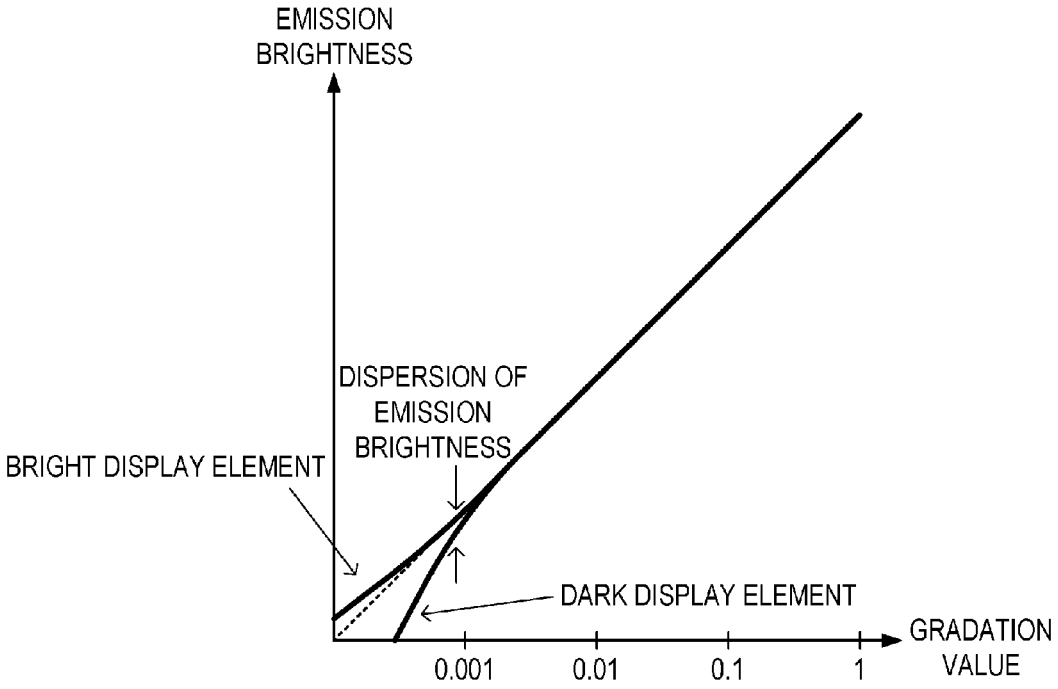
FIG. 2 is a diagram depicting an example of a relationship between a gradation value and emission brightness of a display element according to Example 1.

FIG. 2 shows an example of the relationship between the possible gradation values of the display target image data and the emission brightness of the display elements. The abscissa in FIG. 2 indicates the possible gradation values of the display target image data, and the ordinate in FIG. 2 indicates the emission brightness of the display elements. FIG. 2 is a double-logarithmic graph. The broken line in FIG. 2 indicates the ideal characteristic of the display elements. As FIG. 2 shows, the dispersion of the emission brightness among the display elements is large in the range of very low gradation values. In other words, the brightness unevenness generated on the screen is large in the range of very low gradation values. FIG. 2 also shows that the brightness unevenness increases as the gradation value of the display target image data is lower.

Therefore in this example, a gradation value, where the value of the brightness unevenness matches with a first value, is used as the first gradation value. Humans have a visual characteristic whereby they can see a brightness difference at not less than about 10% when viewing an object having low brightness. Therefore a gradation value where the value of the brightness unevenness becomes 10%, for example, can be used as the first gradation value.

It is expected that the brightness unevenness can be corrected even in a range of quantization errors of the image data that is inputted to the display panel 101. For example, if a number of bits of the image data is 10 bits, the quantization errors in the low gradation range is not less than several % of the target value. Therefore the gradation value, where the value of the brightness unevenness matches with the quantization error, may be used as the first gradation value.

The way of determining the value of the brightness unevenness is arbitrary. For example, a value generated by normalizing the standard deviation of the dispersion of the emission brightness among the light emitting elements by an ideal value of the emission brightness may be used as the brightness unevenness value. The brightness unevenness value may be determined using the emission brightness of all the light emitting elements, or may be determined using the emission brightness of a part of the display elements (representative elements).

The second gradation value is a value lower than the first gradation value. In this example, a value that is close to the minimum value of the possible values of the gradation value and is greater than this minimum value is set as a gradation value corresponding to black, and display elements emit light even when an image based on the image data of the gradation value corresponding to black is displayed. The gradation value corresponding to black is used as the second gradation value. The gradation value corresponding to black is determined depending on the operation mode of the image display apparatus, for example. In concrete terms, in an operation mode emulating a CRT display, a low value is set as the gradation value corresponding to black, and in an operation mode emulating a liquid crystal display, a high value is set as the gradation value corresponding to black.

The minimum value of the possible values of the gradation value may be set as the second gradation value. The second generation value is not limited to the gradation value corresponding to black. For example, a gradation value where the brightness unevenness value matches with the second value may be use as the second gradation value. The second value is a value greater than the first value, and is 50%, for example. In particular, if the display elements do not emit light when an image based on the image data of the gradation value corresponding to black (e.g. when the gradation value corresponding to black is 0), it is preferable to use a gradation value, where the brightness unevenness value matches with the second value, as the second gradation value.

The first correction data storage unit 103 is a first storage unit that stores first correction data to reduce brightness unevenness that is generated on the screen when an image based on the image data of the first gradation value is displayed on the screen. The first correction data can be generated based on the measurement result of the emission brightness of each display element when the image data of the first gradation value is inputted to the display panel 101. For example, data for each display element, which indicates a difference between the emission brightness of the display element when the image data of the first gradation value is inputted to the display panel 101 and the ideal value, can be generated as the first correction data.

The second correction data storage unit 104 is a second storage unit that stores second correction data to reduce brightness unevenness that is generated on the screen when an image based on the image data of the second gradation value is displayed on the screen. The second correction data can be generated based on the measurement result of the emission brightness of each display element when the image data of the second gradation value is inputted to the display panel 101. For example, data for each display element, which indicates a difference between the emission brightness of the display element when the image data of the second gradation value is inputted to the display panel 101 and the ideal value, can be generated as the second correction data.

The correction value determination unit 105 reads the first gradation value and the second gradation value from the threshold storage unit 102, reads the first correction data from the first correction data storage unit 103 (first read processing), and reads the second correction data from the second correction data storage unit 104 (second read processing). Then the correction value determination unit 105 determines a correction value for each display element, and outputs the correction value for each display element to the image correction unit 106. The correction value is a value for correcting the gradation values of the input image data, and is determined based on the gradation values of the input image data, the first gradation value, the second gradation value, the first correction data and the second correction data.

The image correction unit 106 corrects, for each display element, the gradation value of the input image data corresponding to the display element, using a correction value which the correction value determination unit 105 determined for this display element. In this example, an addition value, which is added to the gradation value of the input image data, is determined as the correction value. For each display element, the image correction unit 106 adds the correction value, which the correction value determination unit 105 determined for this display element, to the gradation value of the input image data corresponding to this display element. Then the image correction unit 106 outputs the image data after the correction using the correction value to the display panel 101.

The correction value is not limited to the addition value that is added to the gradation value of the input image data. For example, a coefficient, by which the gradation value of the input image data is multiplied, may be used as the correction value.

Figure 3:
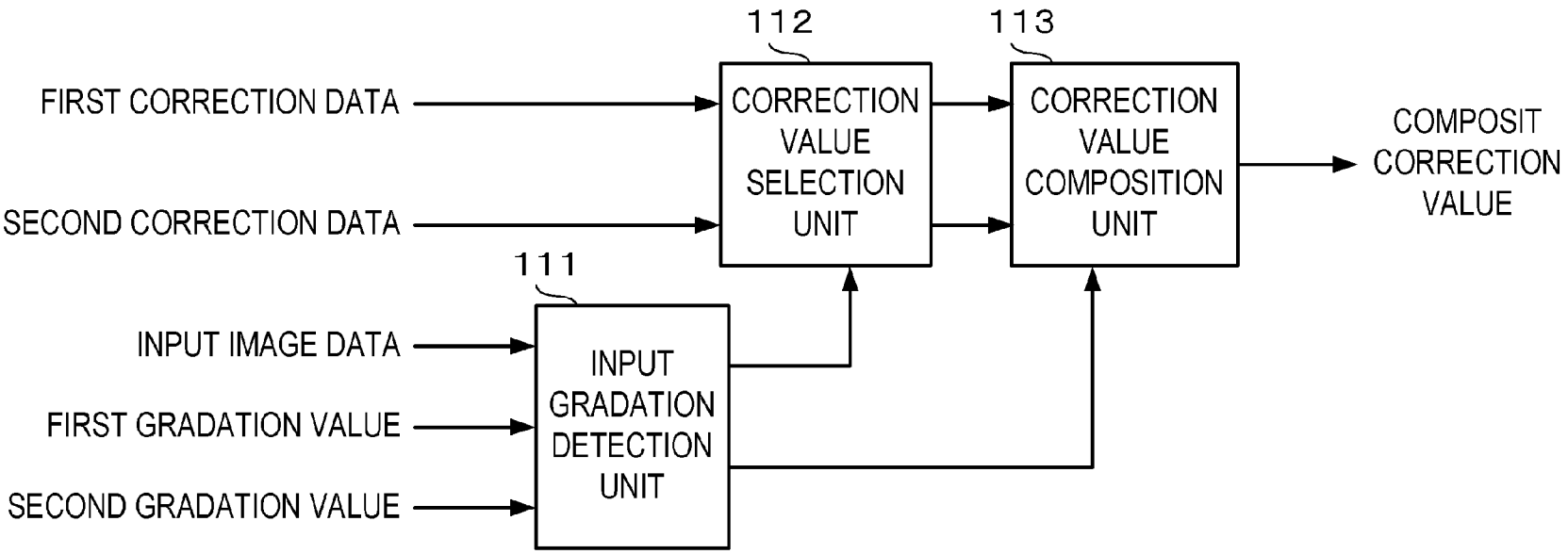
FIG. 3 is a diagram depicting an example of a functional configuration of a correction value determination unit according to Example 1.

FIG. 3 is an example of a functional configuration of the correction value determination unit 105. As shown in FIG. 3, the correction value determination unit 105 includes an input gradation detection unit 111, a correction value selection unit 112, and a correction value composition unit 113. FIG. 4 shows an example of an operation of the correction value determination unit 105. In FIG. 4, "d" denotes the gradation value of the input image data, "th" denotes the first gradation value, and "bl" denotes the second gradation value.

In this example, the correction value is determined so that gradation values, which are not less than the first gradation value, out of the gradation values of the input image data, are corrected using at least the first correction value, and the gradation values, which are less than the first gradation value, are corrected using at least the second correction data.

In this example, the correction data indicates a correction value for correcting the gradation value for each display element.

The input gradation detection unit 111 acquires the input image data, the first gradation value and the second gradation value. The input gradation detection unit 111 performs gradation range determination processing and internal division ratio determination processing using the input image data, the first gradation value and the second gradation value. The input gradation detection unit 111 outputs the result of the gradation range determination processing to the correction value selection unit 112, and outputs the result of the internal division ratio determination processing to the correction value composition unit 113.

The gradation range determination processing is processing to determine the gradation range where the gradation values of the input image data belong (range of gradation values). In this example, the gradation value of the input image data (input gradation value) is compared with the first gradation value and the second gradation value. Thereby, it is determined which of the three gradation ranges the input gradation value belongs to: the gradation range which is not less than the first gradation value; the gradation range which is greater than the second gradation value and less than the first gradation value; and the gradation range which is not greater than the second gradation value.

The internal division ratio determination processing is a processing to determine the internal division ratio from the gradation range where an input gradation value belongs and the input gradation value. For example, if an input gradation value belongs to a gradation range which is not less than the first gradation value, 1 is determined as the internal division ratio. If an input gradation value belongs to a gradation range which is greater than the second gradation value and is less than the first gradation value, a ratio of a value generated by subtracting the second gradation value from the input gradation value, with respect to a value generated by subtracting the second gradation value from the first gradation value, is determined as the internal division ratio. If an input gradation value belongs to a gradation range which is not greater than the second gradation value, a ratio of a value generated by subtracting a minimum value of possible values of the gradation value from the input gradation value, with respect to a value generated by subtracting the minimum value from the second gradation value, is determined as the internal division ratio. In this example, the minimum value of the possible values of the gradation value is 0. Therefore the ratio of the input gradation value with respect to the second gradation value is determined as the internal division ratio.

The correction value selection unit 112 acquires the first correction data and the second correction data as a result of the gradation range determination processing. Then the correction value selection unit 112 selects two correction values A and B according to the result of the gradation range determination processing, and outputs the selected correction values A and B to the correction value composition unit 113. For example, if an input gradation value belongs to the gradation range which is not less than the first gradation value, the correction value indicated by the first correction data is selected as the correction values A and B. If an input gradation value belongs to the gradation range which is greater than the second gradation value and is less than the first gradation value, the correction value indicated by the first correction data is selected as the correction value A, and the correction value indicated by the second correction data is selected as the correction value B. If an input gradation value belongs to the gradation range which is not greater than the second gradation value, the correction value indicated by the second correction data is selected as the correction value A, and a non-correction value (0), which is not for correcting the gradation value, is selected as the correction value B.

The correction value composition unit 113 generates a composite correction value by performing weighted composition of the correction values A and B, which were outputted from the correction value selection unit 112, with weighting, and outputs the composite correction value to the image correction unit 106. In this example, the internal division ratio determined in the internal division ratio determination processing is used as the weight for the correction value A, and (1-internal division ratio) is used as the weight for the correction value B. In other words, in this example, the composite correction value hc is calculated using the following Expression 1. In Expression 1, "k" denotes the internal division ratio, "ha" denotes the correction value A, and "hb" denotes the correction value B.

$$h\ c = h\ a \times k + h\ b \times (1-k) \qquad \text{(Expression 1)}$$

As a result, if an input gradation value belongs to the gradation range which is not less than the first gradation value, a value the same as the correction value indicated by the first correction data is generated as the composite correction value. If an input gradation value belongs to the gradation range which is greater than the second gradation value and is less than the first gradation value, a value generated by performing the weighted composition of the correction value indicated by the first correction data and the correction value indicated by the second correction data, using weights corresponding to the difference between the input gradation value and the second gradation value, is generated as the composite correction value. If an input gradation value belongs to the gradation range which is not greater than the second gradation value, a value generated by performing the weighted composition of the correction value indicated by the second correction data and the non-correction value, using weights corresponding to the difference between the input gradation value and the minimum value of the possible values of the gradation value, is generated as the composite correction value.

The image correction unit 106 corrects the gradation value of the input image data using the composite correction value.

In this way, according to this example, the gradation value, which is not less than the first gradation value, is corrected using the correction value indicated by the first correction data. The gradation value, which is greater than the second gradation value and less than the first gradation value, is corrected using the correction value indicated by the first correction data and the correction value indicated by the second correction data. In concrete terms, a weighted composition of the corrected value indicated by the first correction data and the correction value indicated by the second correction data is performed, using the internal division ratio which is determined for the input gradation value, and the input gradation value is corrected using the correction value after performing the weighted composition. Then the gradation value which is not greater than the second gradation value is corrected using the correction value indicated by the second correction data and the non-correction value. In concrete terms, a weighted composition of the correction value indicated by the second correction data and the non-correction value is performed, using the internal division ratio which is determined for the input gradation value, and the input gradation value is corrected using the correction value after performing the weighted composition.

The method of weighting is not limited to the above mentioned method. For example, the correction value composition unit 113 may calculate the mean value of the correction values A and B, and output the calculated mean value. The correction value composition unit 113 may select a correction value which corresponds to a gradation value closer to the input gradation value out of the correction values A and B, and output the selected correction value.

As described above, according to this example, a gradation value which is not less than the first gradation value, out of the gradation values of the input image data, is corrected using at least the first correction data, and a gradation value, which is less than the first gradation value, is corrected using at least the second correction data. In other words, the correction method is switched depending on whether the gradation value of the input image data is not less than the first gradation value. Thereby the brightness unevenness of the display image of the self-emitting display apparatus, such as an organic EL display apparatus, can be reduced at high accuracy without causing a deterioration in the image quality of the display image. In concrete terms, according to this example, emission of the light emitting elements is not controlled by time-division, hence deterioration in the image quality of the displayed image can be suppressed. Further, by using two correction data, the brightness unevenness can be reduced at high accuracy, even in a range of very low gradation values where the input voltage of the display elements is not greater than Vth.

In this example, a case when a value, which is used as a weight of the gradation value A, is determined as the internal division ratio in the internal division ratio determination processing, was described, but the present invention is not limited to this. For example, in the internal division ratio determination processing, a value which is used as a weight of the gradation value B may be used as the internal division ratio. The value which is used as the gradation value A and the value which is used as the gradation value B may be determined as the internal division ratio respectively. Further, the difference of the gradation values may be calculated instead of the internal division ratio. For example, if the input gradation value belongs to the gradation range which is greater than the second gradation value and is less than the first gradation value, the difference between the input gradation value and the second gradation value may be calculated. If an input gradation value belongs to the gradation range which is not greater than the second gradation value, the difference between the input gradation value and the minimum value of the possible values of the gradation values may be calculated. In this case, the correction value composition unit 113 may determine a weight according to the difference of the gradation values, and perform the weighted composition of the correction values A and B using the determined weights. When an input gradation value belongs to the gradation range which is not less than the first gradation value, it is sufficient if the correction value indicated by the first correction data is determined as the composite correction value, and the difference of the gradation values need not be determined.

In this example, a case of determining the first gradation value based on the value of the brightness unevenness was described, but the method of determining the first gradation value is not limited to this. For example, in a range of very low gradation values where the input voltage of the display element is not greater than the Vth of the TFT, dispersion of the emission brightness among the display elements increases, and the shape of the brightness unevenness changes. Therefore the first gradation value may be determined based on the measurement result of the brightness unevenness on the entire screen as follows.

Figure 5:
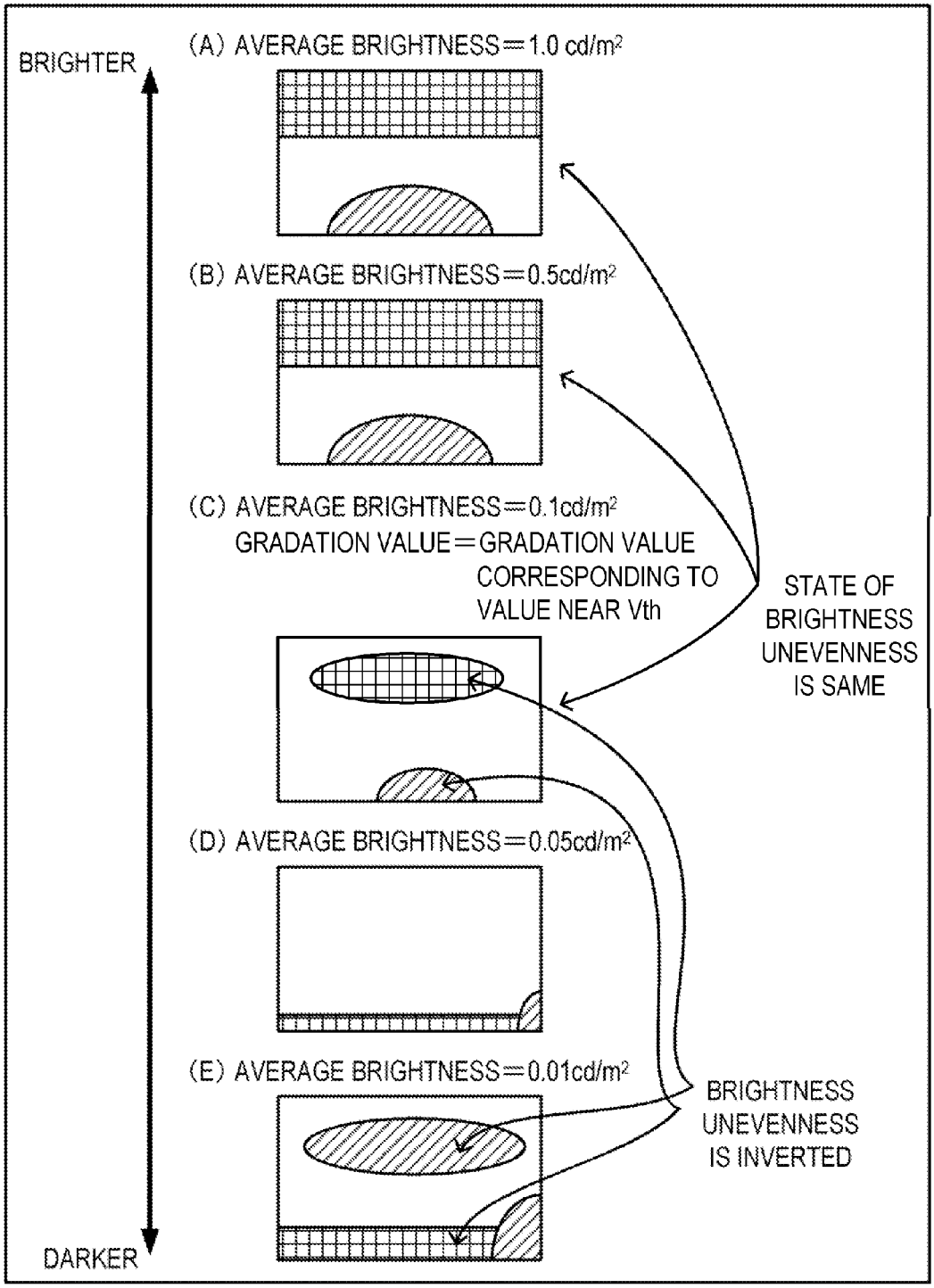
FIG. 5 is a diagram depicting an example of brightness unevenness of an entire screen according to Example 1.

FIG. 5 shows an example of the brightness unevenness of the entire screen. In concrete terms, FIG. 5 is an example of the measurement result of the brightness unevenness on the entire screen when a solid image, of which gradation values are uniform, is displayed on the entire screen. In FIG. 5, the gradation values of the solid image are (A)>(B)>(C)>(D)>(E). FIG. 5 also indicates the average brightness on the entire screen. The gradation value of the solid image corresponding to (C) of FIG. 5 is the gradation value where the input voltage of the display elements becomes close to the Vth of the TFT. In FIG. 5, the shade portion is a region where the emission brightness is higher than its surroundings, and the half tone meshed portion is a region where the emission brightness is lower than its surroundings.

In (A) to (C) of FIG. 5, brightness unevenness (first brightness unevenness), where the brightness decreases in the upper portion of the screen and the brightness increases in the lower portion of the screen, is generated. In (E) of FIG. 5, brightness unevenness, that is completely different from (A) to (C) of FIG. 5, is generated. In concrete terms, in (E) of FIG. 5, brightness unevenness (second brightness unevenness), where the brightness increases in the upper portion of the screen and the brightness decreases in the lower portion of the screen, is generated. In (D) of FIG. 5, brightness unevenness, that is midway between the first brightness unevenness and the second brightness unevenness, is generated. In other words, FIG. 5 shows that the brightness unevenness changes from the first brightness unevenness to the second brightness unevenness as the gradation value of the display target image data decreases. Therefore the brightness unevenness may be measured a plurality of times corresponding to the plurality of gradation values, and a gradation value between a gradation value where the first brightness unevenness is generated and a gradation value where the second brightness unevenness is generated may be determined as the first gradation value. For example, the gradation value corresponding to (D) of FIG. 5 may be determined as the first gradation value.

In this example, a case of the first gradation value which is a fixed value was described, but the present invention is not limited to this. The duty ratio of a display element may change because of the change of the driving conditions of the image display apparatus. For example, the duty ratio of the display element may change because of the change in the display frame rate of the image display apparatus. Further, the duty ratio of the display element may change by setting a black insertion mode, in which a frame of a black image is inserted between the frames of the display target image data. Therefore the image processing apparatus according to this example may further include a determination unit that determines the first gradation value based on the duty ratio. If such a determination unit is used, the first gradation value can be dynamically changed, and an appropriate value can always be used as the first gradation value. The duty ratio is a ratio of a length of the light emitting period of the display element in one frame period of the display target image data, with respect to a length of one frame period of the display target image data.

In this example, a case of selecting the gradation range, to which the input gradation value belongs, from the three gradation ranges was described, but the present invention is not limited to this.

For example, the gradation range, to which the input gradation value belongs, may be selected from two ranges: a gradation range which is not less than the first gradation value; and a gradation range which is less than the first gradation value. Then when an input gradation value belongs to the gradation range which is not less than the first gradation value, the input gradation value may be corrected using the correction value indicated by the first correction data, and when an input gradation value belongs to the gradation range which is less than the first gradation value, the input gradation value may be corrected using the correction value indicated by the second correction data. When an input gradation value belongs to the gradation range which is less than the first gradation value, the input gradation value may be corrected using a composite correction value generated by performing the weighted composition of the correction value indicated by the first corrected data and the correction value indicated by the second correction data. The weighted composition can be performed using the above mentioned method.

A third gradation value, which is greater than the first gradation value, may be predetermined so that the gradation range, which is not less than the first gradation value and is less than the third gradation value, and the gradation range, which is not less than the third gradation value, are set instead of the gradation range which is not less than the first gradation value. For the input gradation value which is not less than the first gradation value, a composite correction value may be generated by performing a weighted composition of the correction value indicated by the first correction data and a non-correction value. In concrete terms, a weighted composition of the correction value indicated by the first correction data and the non-correction data may be performed so that a composite correction value closer to the non-correction value is acquired as the input gradation value is closer to the third gradation value, and a composite correction value closer to the correction value indicated by the first correction data is acquired as the input gradation value is closer to the first gradation value.

Example 2

An image processing apparatus and an image processing method according to Example 2 of the present invention will now be described with reference to the drawings. In this example, a configuration that allows to decrease the storage capacity of the storage unit to store the correction data and to reduce the manufacturing cost of the image processing apparatus will be described.

As shown in FIG. 2, the dispersion of the emission brightness among the display elements is greater as the display brightness (gradation value of the display target image data) is lower. In other words, if the display brightness is high, the dispersion of the emission brightness among the display elements is small. Therefore even if correction data, which is more coarse than the second correction data, is used as the first correction data, the brightness unevenness can be corrected at high accuracy.

Therefore in this example, the first correction data of which data volume is less than the second correction data is provided, and the storage capacity of the first correction data storage unit 103 is decreased to be less than the storage capacity of the second correction data storage unit 104. Thereby the total storage capacity of the first correction data storage unit 103 and the second correction data storage unit 104 is reduced.

A functional configuration of the image processing apparatus according to this example is similar to Example 1. However the first correction data storage unit 103 and the second correction data storage unit 104 are different from Example 1.

In this example, correction data of which number of bits is less than the second correction data is provided as the first correction data. For example, correction data that indicates a four-bit correction value for each display element is provided as the first correction data, and correction data that indicates a five-bit correction value for each display element is provided as the second correction data.

The first correction data storage unit 103 is a first storage unit that stores the first correction data. The storage capacity of the first correction data storage unit 103 is sufficient if the first correction data can be stored. For example, if a number of bits of the correction value indicated by the first correction data is 4, then it is sufficient if the first correction data storage unit 103 has a storage capacity that can store a four-bit correction value for each display element.

The second correction data storage unit 104 is a second storage unit that stores the second correction data. The storage capacity of the second correction data storage unit 104 is sufficient if the second correction data can be stored. For example, if a number of bits of the correction value indicated by the second correction data is five, then it is sufficient if the second correction data storage unit 104 has a storage capacity that can store a five-bit correction value for each display element.

By decreasing a number of bits of the first correction data to be less than the second correction data like this, the storage capacity of the first correction data storage unit 103 can be reduced without dropping the accuracy of the brightness unevenness correction very much.

A case when a number of bits of the correction value indicated by the first correction data is 4 and a number of bits of the correction value indicated by the second correction data is 5 will be described. In this case, it is sufficient if the storage capacity of the first correction data storage unit 103 is not less than a number of display elements×4 bits. On the other hand, if the first correction data that indicates the correction value of which number of bits is the same as the correction value indicated by the second correction data is used, the storage capacity of the first correction data storage unit 103 must be not less than a number of display elements×5 bits. Therefore in this example, the storage capacity of the first correction data storage unit 103 can be reduced to a 10% minimum compared with the case of using the first correction data of which a number of bits is the same as the correction value indicated by the second correction data.

As described above, according to this example, correction data of which a number of bits is less than the second correction data is used as the first correction data. Thereby the storage capacity of the first correction data storage unit can be reduced without dropping the accuracy of the brightness unevenness correction very much. Moreover, the manufacturing cost of the image processing apparatus can be reduced.

Example 3

An image processing apparatus and an image processing method according to Example 3 of the present invention will now be described with reference to the drawings. In Example 2, the configuration that allows to decrease the storage capacity of the storage unit to store the correction data by reducing a number of bits of the first correction data, whereby the manufacturing cost of the image processing apparatus is reduced, was described. In this example, another configuration that allows to decrease the storage capacity of the storage unit and to reduce the manufacturing cost of the image processing apparatus will be described.

As shown in FIG. 2, the dispersion of the emission brightness among the display elements is small if the display brightness (gradation value of the display target image data) is high. As FIG. 5 shows, the brightness unevenness is also generated when the display brightness is high. As these observations on the brightness unevenness show, brightness unevenness that gently changes, rather than brightness unevenness where the emission brightness changes in the display element unit, is dominant in the gradation range which is not less than the first gradation value. Therefore in the gradation range which is not less than the first gradation value, it is effective to reduce only the above mentioned brightness unevenness that gently changes.

Therefore in this example, the correction data to indicate the correction value for each of a plurality of divided regions constituting the region of the screen is used as the first correction data and the second correction data. Then a divided region that is larger than the divided region of the second correction data is used as the divided region of the first correction data. In concrete terms, the correction data to indicate the correction value for each display element is used as the second correction data. And the correction data to indicate the correction value for each divided region constituted by a plurality of display elements is used as the first correction data. Thereby the storage capacity of the first correction data storage unit 103 can be decreased to be less than the storage capacity of the second correction data storage unit 104.

The functional configuration of the image processing apparatus according to this example is similar to Example 1. However the first correction data storage unit 103 and the correction value determination unit 105 are difference from Example 1.

The first correction data storage unit 103 is a first storage unit to store the first correction data. In this example, correction data to indicate a correction value for each divided region constituted by a plurality of display elements is provided as the first correction data. For example, the correction data to indicate a correction value is provided as the first correction data, for each divided region constituted by 32 (horizontal direction)×32 (vertical direction) of display elements.

The correction value determination unit 105 determines a composite correction value for each display element, and outputs the composite correction value for each display element. In this example, the correction value determination unit 105 converts the first correction data, which indicates a correction value for each divided region, into correction data which indicates a correction value for each display element, and uses this correction data. The first correction data can be converted by linear interpolation, for example.

The method of using the first correction data is not limited to the above method. For example, if the composite correction value for a display element is determined using the first correction data, the correction value of the divided region where this display element belongs may be used as the correction value for this display element.

Figure 6:
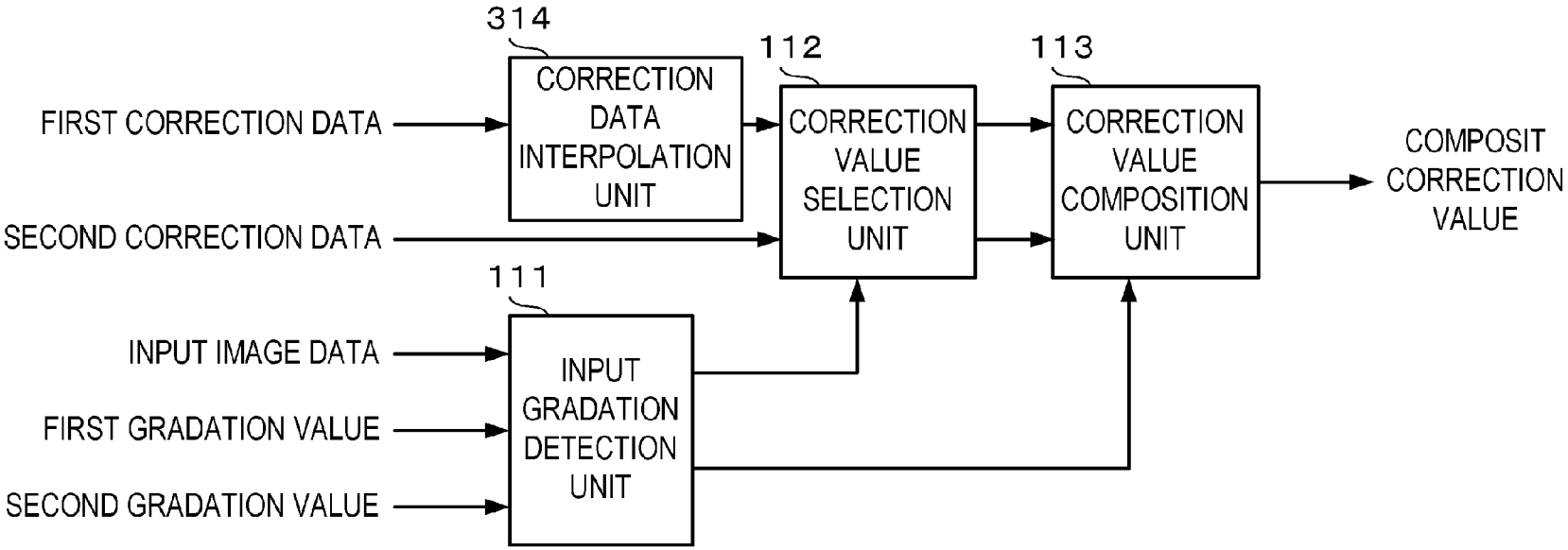
FIG. 6 is a diagram depicting an example of a functional configuration of a correction value determination unit according to Example 3.

FIG. 6 is an example of the functional configuration of the correction value determination unit 105 according to this example. The correction value determination unit 105 of this example further includes a correction data interpolation unit 314, in addition to the functional units of the correction value determination unit 105 of Example 1.

The correction data interpolation unit 314 converts the first correction data, which indicates the correction value for each divided region, into the correction data, which indicates the correction value for each display element, by linear interpolation. Then the correction data interpolation unit 314 outputs the converted correction data to the correction value selection unit 112 as the first correction data.

The functional units, other than the correction data interpolation unit 314, have the same functions as Example 1.

According to this example, a divided region, which is larger than the divided region of the second correction data, is used for the divided region of the first correction data. Thereby the storage capacity of the first correction data storage unit can be reduced without dropping the accuracy of the brightness unevenness correction very much. Furthermore, the manufacturing cost of the image processing apparatus can be reduced. For example, if the first correction data indicates a correction value for each divided region which is constituted by 32 (horizontal direction)×32 (vertical direction) display elements, the data volume of the first correction data is reduced to 1/1024, compared with the case of the first correction data indicating a correction value for each display element. Thereby the storage capacity of the first correction data storage unit 103 can be reduced.

If the reduction of the data volume by this example and the reduction of the data volume by Example 2 are combined, the data volume can be reduced even more dramatically.

In this example, a case when the divided region of the first correction data is a region constituted by a plurality of display elements and the divided region of the second correction data is a region constituted by one display element was described, but the present invention is not limited to this. It is sufficient if the divided region of the first correction data is larger than the divided region of the second correction data, and the divided region of the second correction data may be a region constituted by a plurality of display elements. For example, if it is difficult to measure the emission brightness for each display element when the image data of the second gradation value is displayed for such a reason as the screen being too dark, the emission brightness may be measured for each divided region constituted by a plurality of display elements. Then the second correction data which indicates the correction value for each divided region may be generated based on the measurement result for each divided region. If such second correction data is used, the effect of reducing the change of the emission brightness, which is generated in the display element unit in the low gradation range, is diminished. However, even if this second correction data is used, the brightness unevenness on the entire screen and the change of the emission brightness, which is generated in the display element unit at a value near the first gradation value, can be reduced at high accuracy.

Example 4

An image processing apparatus and an image processing method according to Example 4 of the present invention will now be described with reference to the drawings.

In this example, a case of correcting the internal division ratio (weight of the correction value), based on the display characteristic on the correspondence between the gradation values and the emission brightness of the display elements, will be described. The display characteristic is, for example, the V-I characteristic of the TFT. In this example, the method of correcting the internal division ratio (e.g. correction coefficient that is used for correcting the internal division ratio) is changed between the gradation range which is less than the first gradation value, and the gradation range which is not less than the first gradation value. Thereby a more appropriate value for the composite correction value can be acquired, and the brightness unevenness can be decreased at even higher accuracy.

In this example, a case when the gradation range used for the gradation range determination processing is different from Example 1 will be described. In concrete terms, in this example, a case when four gradation ranges are used in the gradation range determination processing will be described. The gradation ranges, however, are not limited to the four gradation ranges described below. For example, in this example, three gradation ranges, which are the same as Example 1, may be used.

The functional configuration of the image processing apparatus according to this example is similar to Example 1. However, the correction value determination unit 105 is different from Example 1.

Figure 7:
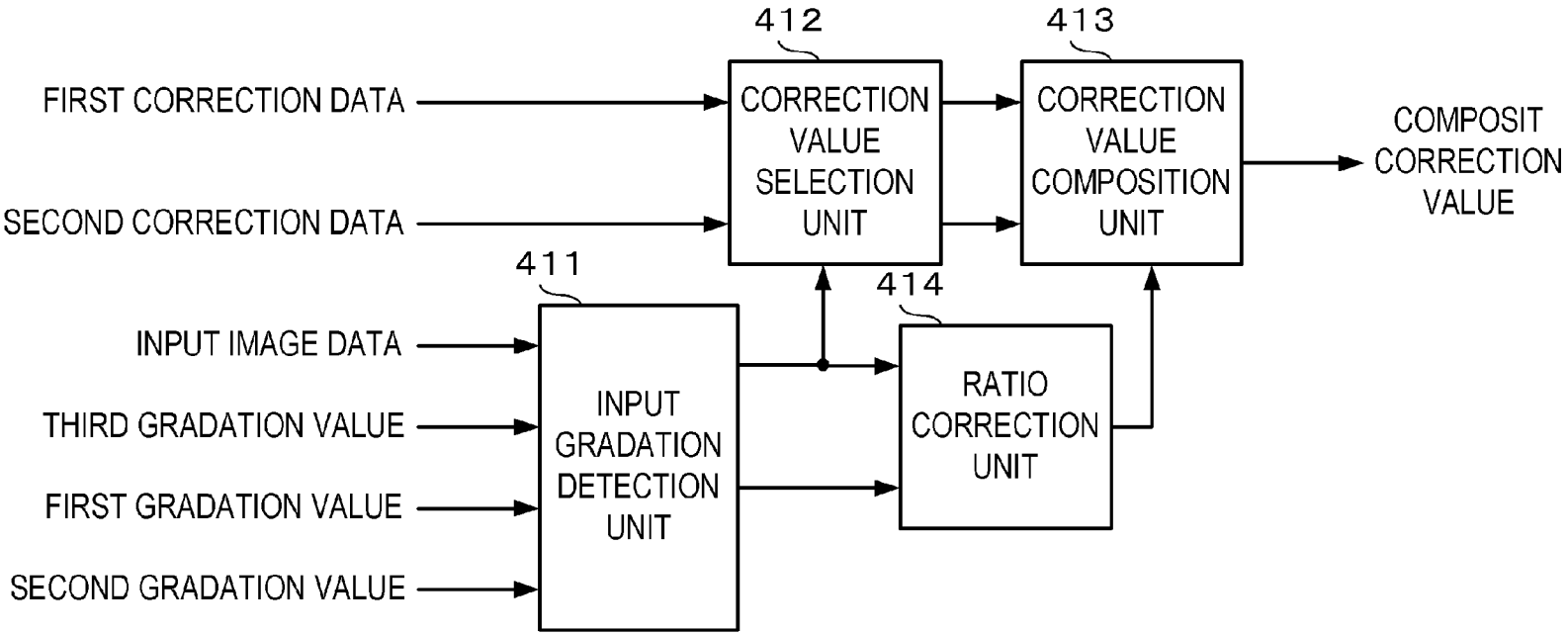
FIG. 7 is a diagram depicting an example of a functional configuration of a correction value determination unit according to Example 4.

FIG. 7 is an example of the functional configuration of the correction value determination unit 105 according to this example. The correction value determination unit 105 of this example includes an input gradation detection unit 411, a correction value selection unit 412, a correction value composition unit 413 and a ratio correction unit 414.

FIG. 10 shows an example of an operation of the correction value determination unit 105 of this example. In FIG. 10, "d" denotes the gradation value of the input image data, "th" denotes the first gradation value, "bl" denotes the second gradation value, and "p3" denotes the third gradation value. In this example, the correction value is determined so that the gradation values, which are greater than the first gradation value and are less than the third gradation value, out of the gradation values of the input image data, are corrected using at least the first correction data, and the gradation values which are less than the first gradation value are corrected using at least the second correction data.

The input gradation detection unit 411 performs gradation range determination processing and internal division ratio determination processing using the input image data, the first gradation value, the second gradation value and the third gradation value. The input gradation detection unit 411 outputs the result of the gradation range determination processing to the correction value selection unit 412 and the ratio correction unit 414, and outputs the result of the internal division ratio determination processing to the correction value composition unit 413.

In this example, the third gradation value, which is greater than the first gradation value, is predetermined.

In the gradation range determination processing, the gradation value of the input image data (input gradation value) is compared with the first gradation value, the second gradation value and the third gradation value. Thereby it is determined which one of the four gradation ranges the input gradation value belongs to: the gradation range which is not less than the third gradation value; the gradation range which is not less than the first gradation value and is less than the third gradation value; the gradation range which is greater than the second gradation value and is less than the first gradation value; and the gradation value which is not greater than the second gradation value.

In the internal division ratio determination processing, if the input gradation value belongs to the gradation range which is not less than the third gradation value, 1 is determined as the internal division ratio. If the input gradation value belongs to the gradation range which is not less than the first gradation value and is less than the third gradation value, a ratio of a value, generated by subtracting the first gradation value from the input gradation value with respect to a value generated by subtracting the first gradation value from the third gradation value, is determined as the internal division ratio. If the input gradation value belongs to the gradation range which is greater than the second gradation value and less than the first gradation value, a ratio of a value, generated by subtracting the second gradation value from the input gradation value with respect to a value generated by subtracting the second gradation value from the first gradation value, is determined as the internal division ratio. And if the input gradation value belongs to the gradation range which is not greater than the second gradation value, a ratio of a value, generated by subtracting the minimum value of possible values of the gradation value from the input gradation value with respect to a value generated by subtracting this minimum value from the second gradation value, is determined as the internal division ratio. In this example, the minimum value of the possible values of the gradation value is 0. Therefore the ratio of the input gradation value with respect to the second gradation value is determined as the internal division ratio.

The correction value selection unit 412 acquires the first correction data and the second correction data based on the result of the gradation range determination processing. The correction value selection unit 412 selects two correction values A and B according to the result of the gradation range determination processing, and outputs the selected correction values A and B to the correction value composition unit 413. In concrete terms, if the input gradation value belongs to the gradation range which is not less than the third gradation value, the non-correction value is selected as the correction values A and B. If the input gradation value belongs to the gradation range which is not less than the first gradation value and less than the third gradation value, the non-correction value is selected as the correction value A, and the correction value indicated by the first correction data is selected as the correction value B. If the input gradation value belongs to the range which is greater than the second gradation value and is less than the first gradation value, the correction value indicated by the first correction data is selected as the correction value A, and the correction value indicated by the second correction data is selected as the correction value B. If the input gradation value belongs to the gradation range which is not greater than the second gradation value, the correction value indicated by the second correction data is selected as the correction value A, and the non-correction value is selected as the correction value B.

The ratio correction unit 414 corrects the internal division ratio determined in the internal division ratio determination processing (weights of the correction values) based on the display characteristic on the correspondence between the gradation values and the emission brightness of the display elements.

In this example, the correspondence of the internal division ratio before the correction and the internal division ratio after the correction (conversion characteristic) is predetermined for each of the four gradation ranges described above. The conversion characteristic is a characteristic determined based on the V-I characteristic of the TFT, for example.

The ratio correction unit 414 selects one of the four conversion characteristics according to the result of the gradation range determination processing, and generates the corrected internal division ratio by correcting the internal division ratio according to the selected conversion characteristic. Then the ratio correction unit 414 outputs the corrected internal division ratio to the correction value composition unit 413.

Figure 8A:
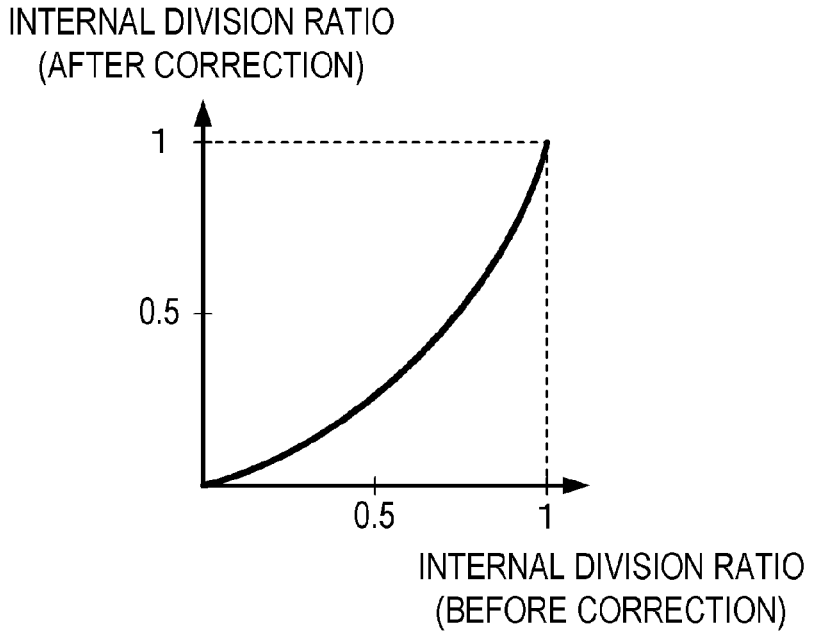
FIG. 8A and FIG. 8B are graphs showing examples of conversion characteristics according to Example 4.
Figure 8B:
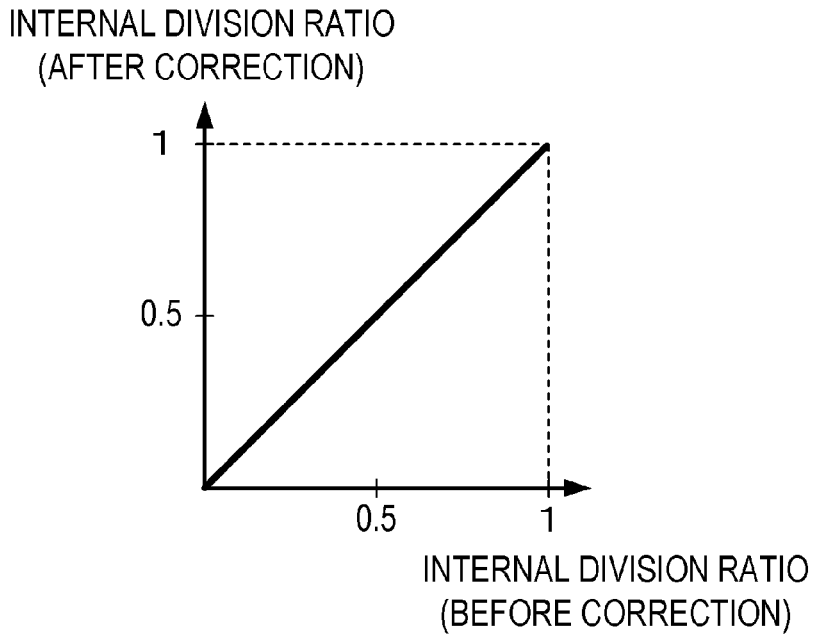
Figure 9:
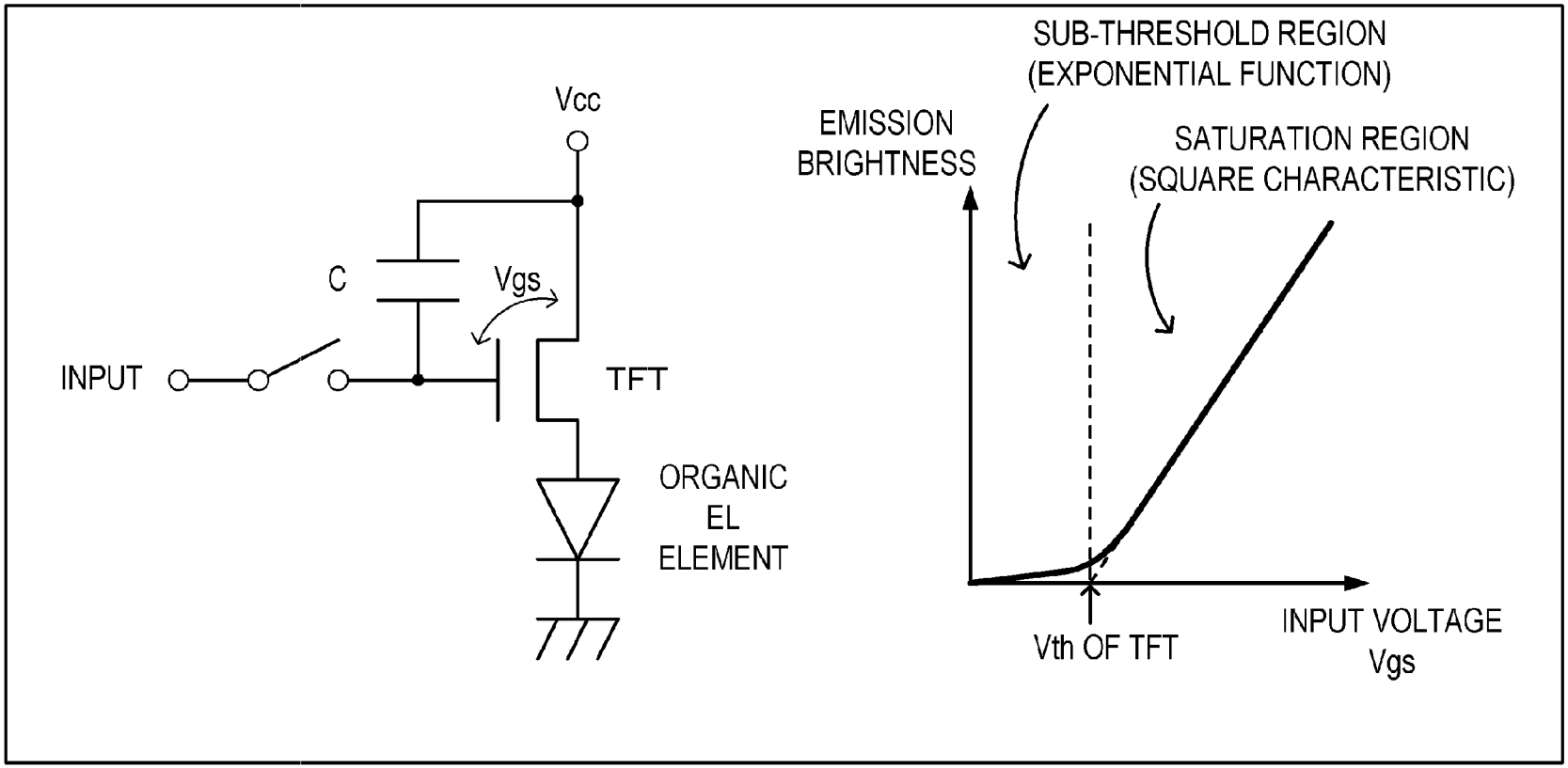
FIG. 9 is a diagram depicting an example of a relationship between the input voltage and the emission brightness of a display element.

FIG. 8A and FIG. 8B show examples of the conversion characteristics. The abscissa of FIG. 8A and FIG. 8B indicates the internal division ratio before correction (before conversion), and the ordinate of FIG. 8A and FIG. 8B indicates the internal division ratio after correction (after conversion).

In the V-I characteristic of a TFT, the current exponentially changes with respect to the change of the voltage, in the gradation range which is less than the first gradation value (the gradation range which is greater than the second gradation value and is less than the first gradation value, and the gradation range which is not greater than the second gradation value). Hence in the gradation range which is less than the first gradation value, the internal division ratio after the correction should be exponentially changed with respect to the internal division ratio before the correction, as shown in FIG. 8A. Therefore in this example, if the input gradation value belongs to the gradation range which is greater than the second gradation value and is less than the first gradation value, or the gradation range which is not greater than the second gradation value, the corrected internal division ratio is determined using the conversion characteristic shown in FIG. 8A.

In the V-I characteristic of the TFT, the current is in proportion to the square of the voltage in the gradation range which is not less than the first gradation value (the gradation range which is not less than the first gradation value and is less than the third gradation value, and the gradation range which is not less than the third gradation value). Hence, in the gradation range which is not less than the first gradation value, the internal division ratio after the correction should be in proportion to the internal division ratio before the correction, as shown in FIG. 8B. Therefore in this example, if the input gradation value belongs to the gradation range which is not less than the first gradation value and is less than the third gradation value, or the gradation range which is not less than the third gradation value, the corrected internal division ratio is determined using the conversion characteristic shown in FIG. 8B.

The correction value composition unit 413 generates a composite correction value by performing the weighted composition of the correction values A and B, just like the correction value composition unit 113 of Example 1, and outputs the composite correction value. In this example however, the corrected internal division ratio generated by the ratio correction unit 414 is used as the weight of the correction value A when the weighted composition is performed.

As a result, if the input gradation value belongs to the gradation range which is not less than the third gradation value, a value the same as the non-correction value is generated as the composite correction value. If the input gradation value belongs to the gradation range which is not less than the first gradation value and is less than the third gradation value, a value generated by the weighted composition of the correction value indicated by the first correction data and the non-correction value, using weights according to the difference between the input gradation value and the first gradation value, is generated as the composite correction value. If the input gradation value belongs to the gradation range which is greater than the second gradation value and is less than the first gradation value, a value generated by the weighted composition of the correction value indicated by the first correction data and the correction value indicated by the second correction data, using weights according to the difference between the input gradation value and the second gradation value, is generated as the composite correction value. If the input gradation value belongs to the gradation range which is not greater than the second gradation value, a value generated by the weighted composition of the correction value indicated by the second correction data and the non-correction value, using weights according to the difference between the input gradation value and the minimum value of the possible values of the gradation value, is generated as the composite correction value.

Then in the image correction unit 106, the gradation values of the input image data are corrected using the composite correction value, just like Example 1.

Thus in this example, a gradation value which is not less than the third gradation value is not corrected. A gradation value, which is not less than the first gradation value and is less than the third gradation value, is corrected using the correction value indicated by the first correction data and the non-correction value. In concrete terms, a weighted composition of the correction value indicated by the first correction data and the non-correction value is performed, using the corrected internal division ratio which was determined for the input gradation value, and the input gradation value is corrected by the correction value generated by the weighted composition. A gradation value, which is greater than the second gradation value and is less than the first gradation value, is corrected using the correction value indicated by the first correction data and the correction value indicated by the second correction data. In concrete terms, a weighted composition of the correction value indicated by the first correction data and the correction value indicated by the second correction data is performed, using the corrected internal division ratio which was determined for the input gradation value, and the input gradation value is corrected by the correction value generated by the weighted composition. A gradation value, which is not greater than the second gradation value, is corrected using the correction value indicated by the second correction data and the non-correction value. In concrete terms, a weighted composition of the correction value indicated by the second correction data and the non-correction value is performed, using the corrected internal division ratio which was determined for the input gradation value, and the input gradation value is corrected by the correction value generated by the weighted composition.

As described above, according to this example, the weight to be used for the weighted composition is corrected based on the display characteristics on the correspondence between the gradation values and the emission brightness of the light emitting elements. Thereby a more appropriate value can be acquired for the composite correction value, and the brightness unevenness can be reduced at even higher accuracy.

The weighted composition may be performed using the internal division ratio determined in the internal division ratio determination processing as the weight, without correcting the internal division ratio.

In this example, a case of not correcting the gradation values which are not less than the third gradation value was described, but the present invention is not limited to this. For example, a gradation value which is not less than the third gradation value may be corrected without using the correction value indicated by the first correction data. And a gradation value, which is not less than the first gradation value and is less than the third gradation value, may be corrected using at least the correction value indicated by the first correction data. In concrete terms, the third correction data for high gradation values, which is different from the first correction data and the second correction data, may be provided. Then a gradation value, which is not less than the third gradation value, may be corrected using the correction value indicated by the third correction data, and a gradation value, which is not less than the first gradation value and is less than the third gradation value, may be corrected using the correction value indicated by the first correction data and the correction value indicated by the third correction data. A gradation value, which is not less than the first gradation value and is less than the third gradation value, may be corrected using only the correction value indicated by the first correction data.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-085605, filed on Apr. 17, 2014, and Japanese Patent Application No. 2015-026682, filed on Feb. 13, 2015, which are hereby incorporated by reference herein in their entirety.

What is claimed is:

1. A self-emitting display apparatus, comprising:

a self-emitting display panel having a plurality of display elements each of which includes an organic EL and a TFT (thin film transistor);

a first storage unit configured to store first correction data for reducing spatial brightness unevenness generated on a screen of a self-emitting display panel when an image based on image data of a first gradation value is displayed on the screen;

a second storage unit configured to store second correction data for reducing spatial brightness unevenness generated on the screen when an image based on image data of a second gradation value, which is lower than the first gradation value, is displayed on the screen; and a correction unit configured to:

(i) determine a gradation value of input image data, which corresponds to each of the plurality of display elements, whether the gradation value belongs to a first gradation range or a second gradation range, the first gradation range being not less than the first gradation value and the second gradation range being not greater than the second gradation value, (ii) correct gradation values, which belong to the first gradation range, of the input image data, in use of the first correction data, and (iii) correct gradation values, which belong to the second gradation range, of the input image data, in use of the second correction data, wherein:

the first gradation value is corresponding to a threshold voltage which is a turning point of change of V-I characteristics of the TFT that supply current to the organic EL element, the first correction data is data related to a difference between emission brightness of each of plural display elements and an ideal value in a case where the image based on the image data of the first gradation value is displayed on the screen, the second correction data is data related to a difference between emission brightness of each of plural display elements and an ideal value in a case where the image based on the image data of the second gradation value is displayed on the screen, and by the corrections in the correction unit, spatial brightness unevenness generated on the screen when an image based on the input image data is displayed on the screen is reduced.

2. The self-emitting display apparatus according to claim 1, wherein the brightness unevenness changes from a first brightness unevenness to a second brightness unevenness, of which a state is different from a state of the first brightness unevenness, as the gradation value of display target image data decreases, and the first gradation value is a gradation value between a gradation value at which the first brightness unevenness is generated and a gradation value at which the second brightness unevenness is generated.

3. The self-emitting display apparatus according to claim 1, further comprising a determination unit configured to determine the first gradation value based on a duty ratio, which is a ratio of a length of light emitting period of a display element of the self-emitting display apparatus in one frame period of display target image data with respect to a length of one frame period of the display target image data.

4. The self-emitting display apparatus according to claim 1, wherein bit number of the first correction data is less than bit number of the second correction data.

5. The image processing apparatus according to claim 1, wherein the first correction data and the second correction data each indicate a correction value correcting a gradation value for each of a plurality of divided regions of the screen, and the divided region of the first correction data is larger than the divided region of the second correction data.

6. The self-emitting display apparatus according to claim 1, wherein a value greater than the minimum value of possible values of the gradation value is set as a gradation value corresponding to black, the self-emitting display apparatus emits light when an image based on image data of the gradation value corresponding to black is displayed, and the second gradation value is the gradation value corresponding to black.

7. The self-emitting display apparatus according to claim 1, wherein the first correction data and the second correction data each indicate a correction value correcting a gradation value, and the correction unit corrects a gradation value, which belongs to the first gradation range, in use of a correction value indicated by the first correction data, corrects a gradation value, which belongs to a third gradation range, in use of a composite correction value generated by performing weighted composition of a correction value indicated by the first correction data and a correction value indicated by the second correction data, the third gradation range being less than the first gradation value and greater than the second gradation value, and corrects a gradation value, which belongs to the second gradation range, in use of a composite correction value generated by performing weighted composition of a correction value indicated by the second correction data and a non-correction value which does not correct a gradation value.

8. The image processing apparatus according to claim 1, wherein the first correction data and the second correction data each indicate a correction value correcting a gradation value, and the correction unit does not correct a gradation value which is not less than a third gradation value, the third gradation value being greater than the first gradation value, corrects a gradation value, which is not less than the first gradation value and is less than the third gradation value, in use of a correction value indicated by the first correction data and a non-correction value which does not correct a gradation value, corrects a gradation value, which is greater than the second gradation value and is less than the first gradation value, in use of a correction value indicated by the first correction data and a correction value indicated by the second correction data, and corrects a gradation value, which is not greater than the second gradation value, in use of a correction value indicated by the second correction data and the non-correction value.

9. The image processing apparatus according to claim 1, wherein the first correction data and the second correction data each indicate a correction value correcting a gradation value, the correction unit corrects a gradation value, which is not less than a third gradation value, without using the correction value indicated by the first correction data, the third gradation value being greater than the first gradation value, corrects a gradation value, which is not less than the first gradation value and is less than the third gradation value, in use of at least the correction value indicated by the first correction data, corrects a gradation value, which is greater than the second gradation value and is less than the first gradation value, in use of the correction value indicated by the first correction data and the correction value indicated by the second correction data, and corrects a gradation value, which is not greater than the second gradation value, in use of the correction value indicated by the second correction data and a non-correction value which does not correct a gradation value.

10. The image processing apparatus according to claim 8, wherein the correction unit performs weighted composition of the correction value indicated by the first correction data and the non-correction value on the basis of weights corresponding to the difference between a gradation value, which is not less than the first gradation value and is less than the third gradation value, and the first gradation value, and corrects the gradation value, which is not less than the first gradation value and is less than the third gradation value, in use of the correction value generated by the weighted composition.

11. The image processing apparatus according to claim 7, wherein the correction unit performs a weighted composition of the correction value indicated by the first correction data and the correction value indicated by the second correction data on the basis of weights corresponding to the difference between a gradation value, which is greater than the second gradation value and is less than the first gradation value, and the second gradation value, and corrects the gradation value, which is greater than the second gradation value and is less than the first gradation value, in use of the correction value generated by the weighted composition.

12. The image processing apparatus according to claim 7, wherein the correction unit performs a weighted composition of the correction value indicated by the second correction data and the non-correction value on the basis of weights corresponding to the difference between the gradation value, which is not greater than the second gradation value, and the minimum value of possible values of the gradation value, and corrects the gradation value which is not greater than the second gradation value, in use of the correction value generated by the weighted composition.

13. The image processing apparatus according to claim 10, wherein the correction unit corrects the weights of the correction values used for performing the weighted composition of the correction values on the basis of display characteristics on the correspondence between the gradation values and emission brightness of the display elements of the self-emitting display apparatus.

14. The self-emitting display apparatus according to claim 1, wherein the brightness unevenness changes from a first brightness unevenness to a second brightness unevenness as the gradation value of display target image data decreases, and spatial brightness change in the second brightness unevenness is larger than spatial brightness change in the first brightness unevenness.

15. The self-emitting display apparatus according to claim 1, wherein the first gradation value is a value determined based on quantization errors according to number of bits of the input image data.

16. The self-emitting display apparatus according to claim 1, wherein the first gradation value is a value determined based on a result obtained by measuring spatial brightness unevenness generated on the screen when an image based on image data, of which gradation values are uniform, is displayed on the screen.

17. A control method of a self-emitting display apparatus, wherein the self-emitting apparatus comprises a self-emitting display panel having a plurality of display elements each of which includes an organic EL element and a TFT (thin film transistor), the control method comprises:

a first reading step of reading first correction data for reducing spatial brightness unevenness generated on a screen of a self-emitting display panel from a first storage unit configured to store the first correction data when an image based on image data of a first gradation value is displayed on the screen;

a second reading step of reading second correction data for reducing spatial brightness unevenness generated on the screen from a second storage unit configured to store the second correction data when an image based on image data of a second gradation value, which is lower than the first gradation value, is displayed on the screen; and a correction step of:

(i) determining a gradation value of input image data, which corresponds to each of the plurality of display elements, whether the gradation value belongs to a first gradation range or a second gradation range, the first gradation range not being less than the first gradation value and the second gradation range being not greater than the second gradation value, (ii) correcting gradation values, which belong to the first gradation range, of input image data, in use of the first correction data, and (iii) correcting gradation values, which belong to the second gradation range, of the input image data, in use of the second correction data, the first gradation value is corresponding to a threshold voltage which is a turning point of change of V-I characteristics of the TFT that supply current to the organic EL element, the first correction data is data related to a difference between emission brightness of each of plural display elements and an ideal value in a case where the image based on the image data of the first gradation value is displayed on the screen, the second correction data is data related to a difference between emission brightness of each of plural display elements and an ideal value in a case where the image based on the image data of the second gradation value is displayed on the screen, and by the corrections in the correction step, spatial brightness unevenness generated on the screen when an image based on the input image data is displayed on the screen is reduced.

* * * * *